United States Patent [19]

Bayer et al.

[11] Patent Number: 4,861,954

[45] Date of Patent: Aug. 29, 1989

[54] PROCESS FOR CONNECTING CONDUCTIVE PARTS OF AN ELECTRICAL SWITCH COMPONENT

[75] Inventors: Helmut Bayer; Peter Sekira, both of Vienna, Austria

[73] Assignee: Electrovac, Fabrikation, Elektrotechnischer Spezialartike, Vienna, Austria

[21] Appl. No.: 134,658

[22] Filed: Dec. 18, 1987

[30] Foreign Application Priority Data

Dec. 18, 1986 [AT] Austria ..... 3380/86

[51] Int. Cl.[4] ..... H01H 1/00

[52] U.S. Cl. ..... 200/284; 29/622; 228/265; 337/112

[58] Field of Search ..... 29/622; 200/284; 337/112, 113, 380, 381; 219/57; 228/164, 265, 44.3, 44.7

[56] References Cited

U.S. PATENT DOCUMENTS

| | | | |
|---|---|---|---|
| 3,192,345 | 6/1965 | Epstein | 337/113 |
| 4,027,385 | 6/1977 | Deubel | 337/112 |
| 4,078,712 | 3/1978 | Cook et al. | 228/265 |
| 4,269,344 | 5/1981 | Vervliet | 228/265 |
| 4,669,182 | 6/1987 | Ferroni et al. | 29/622 |

FOREIGN PATENT DOCUMENTS

| | | | |
|---|---|---|---|
| 2361485 | 4/1975 | Fed. Rep. of Germany . | |
| 2722552 | 11/1978 | Fed. Rep. of Germany . | |
| 3538537 | 6/1986 | Fed. Rep. of Germany . | |
| 215669 | 11/1984 | German Democratic Rep. . | |
| 2063136 | 6/1981 | United Kingdom | 228/265 |
| 2088133 | 6/1982 | United Kingdom | 29/622 |

*Primary Examiner*—Renee S. Luebke

*Attorney, Agent, or Firm*—Laurence R. Brown; Alfred J. Mangels

[57] ABSTRACT

For simplified and more rapid production of a switch component (1) with a bimetallic element (3) and a switch (6) which can be actuated by this via a transmission element (15), the carrier or feed parts (4) are connected to the contact parts (5) by welding. For this purpose, each carrier or feed part (4) has a vertical weld section (8) passed through the insulating body (2) and having a smaller cross sectional surface than the remaining portion of the carrier or feed part (4).

6 Claims, 2 Drawing Sheets

FIG. 1
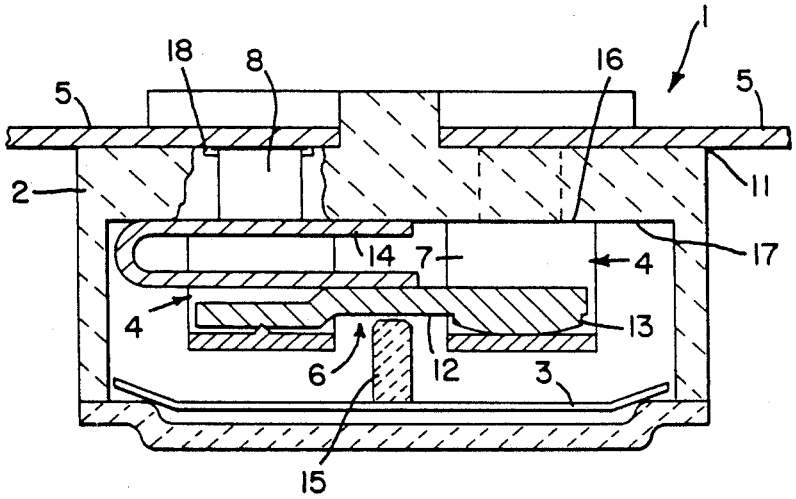
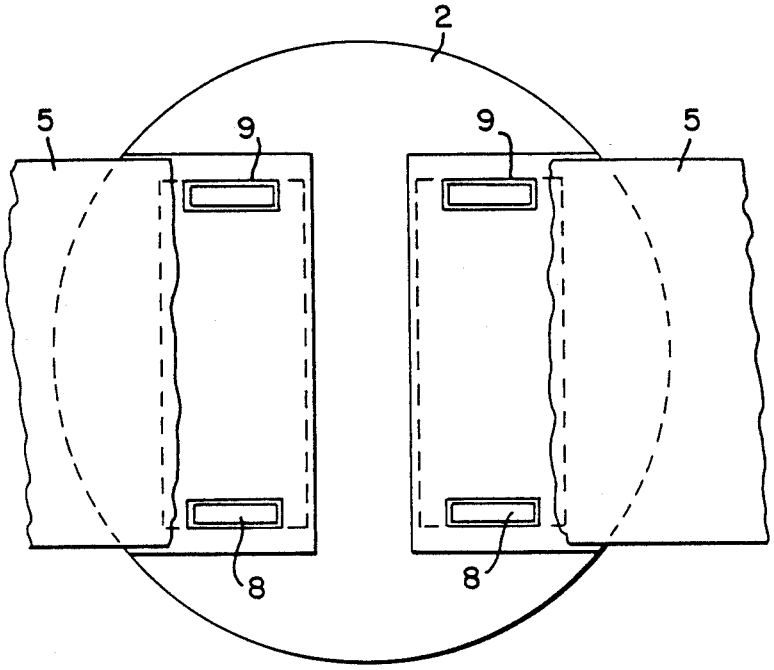
FIG. 2

FIG. 3
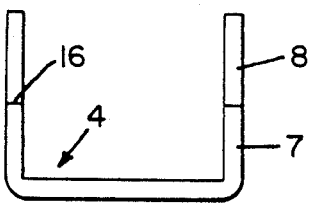
FIG. 4
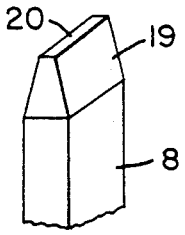
FIG. 5
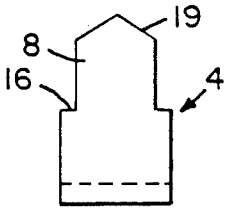
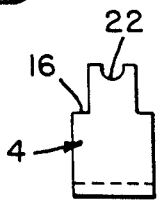
FIG. 6
FIG. 9
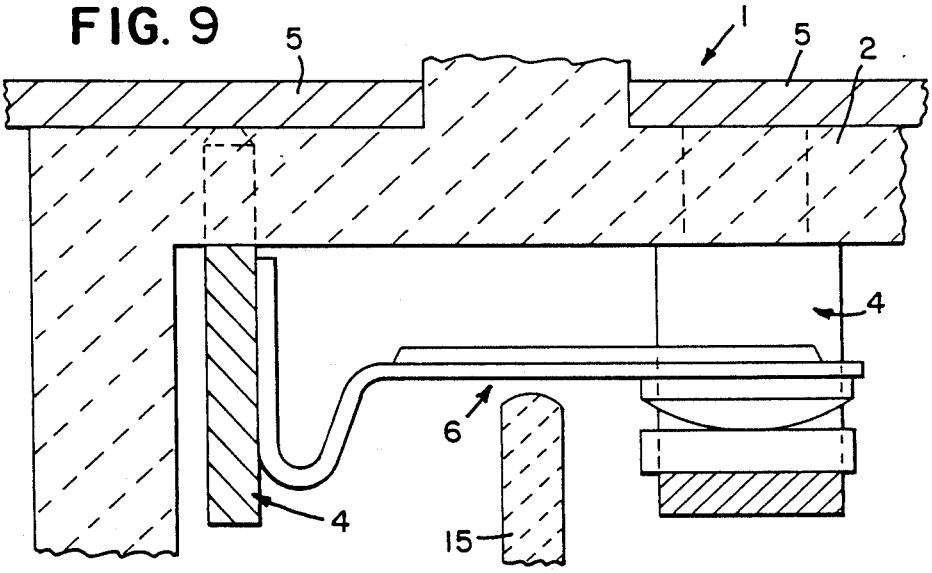
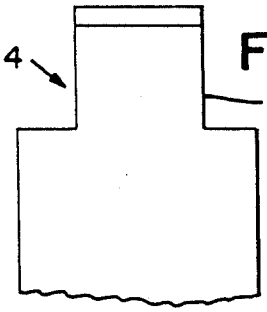
FIG. 7
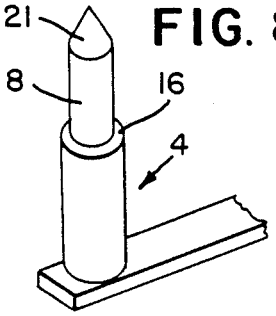
FIG. 8

PROCESS FOR CONNECTING CONDUCTIVE PARTS OF AN ELECTRICAL SWITCH COMPONENT

BACKGROUND OF THE INVENTION

1. Field of the Invention

The invention relates to a process for connecting conductive parts of an electrical switch component, of which conductive parts at least one is surrounded, at least locally, by an element of ceramics or the like high temperature resistant material.

2. Description of the Related Art

According to DE-OS No. 3,558,537, it is already known to rivet together conductive parts of electrical switch components. For this, a metallic part provided as the rivet is fed through a bore of a ceramic, heated with passage of current, and shaped under pressure in the heated state. Such connections have the disadvantage, particularly when used in high environmental temperatures, that in the course of time they become loose and then substantially worsen the passage of current. Apart from this, such mechanical connections are burdened with the disadvantage of high contact resistances, which can rise still further in the course of operation due to the formation of oxides and the like. In addition to this, a further working step is also necessary to thread the rivets through, with this known rivet connection.

The object of the invention is the production of such connections of conductors of an electrical switch component, which are substantially free from electrical contact resistances and, apart from this, make possible an advantageous, more rapid manufacture.

SUMMARY OF THE INVENTION

The object is achieved according to the invention in that the conductive parts are connected together by welding. A connection of this kind can be produced particularly quickly and permanently, after setting the optimum weld duration and current density, and in particular a high temperature in the use of the switch component has no detrimental action on the contact resistance in the region of the weld points. A further advantage of this type of connection is also to be found in that the deformation region is limited to a very short, substantially partial region of the conductive part to be connected.

The invention relates to an electrical switch component with an insulating body, preferably of ceramic, a switch unit attached to a carrier or feed part which is passed through the insulating body and a contact part connected to the carrier or feed part. The invention is characterized in that the carrier or feed part has a smaller cross section, compared to the rest of the carrier section, in its weld section which is passed through the insulating body, the transition region between both sections being constructed with the formation of a support shoulder designed to rest on the insulating body, and that the end of the weld section projecting from the insulating body is connected by a weld to the contact part. Due to the construction of a wider and a narrower section, it is ensured that only the section to be connected to the contact part is heated in the welding process. By the formation of the support shoulder, exact positioning of the end of the weld section to be welded at the place provided is secured when the shoulder abuts the insulating body. Here it is appropriate that the end to be welded be allowed to stand out over the insulation body by exactly the length of the deformation part provided, whence the motion of the contact part pressed with pressure onto the melting end of the weld section is automatically stopped by abutment on the insulation body. In this manner, a precise connection can be produced particularly quickly. By limiting to this end region the deformation of the carrier or feed part during welding, a permanent connection is produced while impermissibly high mechanical stressing of the insulation body already at short action of current is prevented.

A further preferred embodiment of the invention consists in that the carrier or support part is formed with a U-shape and each of the mutually parallel shanks has a respective carrier section adjoining the central, perpendicular shank, and a weld section passed through the insulating body. Such a U-shaped construction of the carrier or support part assures a particularly strong connection to the contact part, and due to the double contact places, practically no contact resistances arise.

According to a further advantageous embodiment of the invention the weld section of the carrier or support part has a circular cross section before the weld to the contact part, with a conical tip provided in the end region. By the pointed construction of the weld section, a particularly rapid and point-form melting can be achieved by a high current density, leading to an immediate fixation of the contact part.

The end of the weld section, provided for connection to the contact part, of the carrier or support part has, according to a further preferred embodiment of the invention, a further, preferably wedge-shaped, step. Such a wedge-shaped step makes possible the formation of a high current density for a linear and stable weld connection, when the carrier or support part is made flat.

A further preferred variant embodiment of the invention consists in that the end of the weld section of the carrier or support part, provided for connection to the contact part, has a central U-shaped aperture, with formation of two mutually spaced-apart weld webs. The construction of weld webs leads to a reduction of cross section of the weld section, so that rapid melting and stable two point connection can be achieved.

Finally, yet another advantageous embodiment of the invention consists in that in the region of the end of the weld section provided for connection to the contact part, depressions are arranged in the insulating body. The melted material of the weld section, pressed out when the contact part is pressed on, can be taken up by these depressions.

BRIEF DESCRIPTION OF THE DRAWINGS

The invention is described in more detail below, with reference to several of the embodiment examples shown in the drawing.

FIG. 1 shows a cross section through a switch component constructed according to the invention, FIG. 2 shows a plan view of the switch component according to FIG. 1, FIGS. 3–8 show enlarged embodiment examples of a carrier or feed part constructed according to the invention, and FIG. 9 shows a greatly enlarged fragmentary cross section through a further embodiment of a switch component according to the invention.

DESCRIPTION OF THE PREFERRED EMBODIMENTS

A switch component (1) visible in FIG. 1 consists essentially of a cylindrical insulating body (2) of ceramic, a bimetallic element (3), two yoke- or U-shaped carrier or feed parts (4), and contact parts (5) arranged on the upper side of the insulation body (2). Each carrier or feed part (4) has a wide carrier section (7) to receive a switch (6) and a narrower weld section (8) which is passed through a corresponding rectangular aperture (9) of the insulation body (2). This weld section (8) of the carrier or feed part (4) is welded by its free end, which stands up above the place (11) of the insulation body (2), to the contact part. The switch (6) consists essentially of a current-conducting bridge (12) connecting together the two carrier or feed parts (4), with an end contact (13) and a spring (14) connected to the bridge (12). A transmission element (15) of electrically insulating material, e.g. ceramic, is guided between the bimetallic element (3) and the bridge (12).

Production of the switch component (1) takes place as follows. After the bridge (12) with the spring (14) is pushed into the insulation body (2), the two carrier or feed parts (4) with their four weld sections (8) are introduced into the openings (9) of the insulation body (2), until the support shoulders (16), located between the carrier and weld section (7) and (8), abut the underside (17) of the insulation body (2). Pressing of the carrier or feed part (4) onto the underside (17) of the insulation body (2) is effected by a tool constructed to act also as the electrode of a welding apparatus. The two contact parts (5), if necessary aided by a tool constructed as the electrode, are pressed against the ends of the weld sections (8) projecting out over the plane (11), so that current flows at high current density through both electrodes. Thus there results melting of the ends of the weld sections and a firm connection to the contact parts (5). The molten material pressed out laterally during melting flows into a depression (18), adjoining the opening (9), of the insulation body (2).

The mode of functioning of the switch component (1) is now as follows. As soon as there is strong heating in the region of the bimetallic element (3), this is bowed up towards the switch (6), and the transmission element (15) leads to a lifting up of the bridge (12) directed against the action of the spring (14). The contact (13) is thereby lifted up from the corresponding carrier or feed part (4), so that the contact between the two carrier or feed parts (4) and the associated contact parts (5), which are respectively connected to a current-conducting conductor, is interrupted. As soon as the bimetallic element (3) bends back again, after cooling, into the initial position shown in FIG. 1, the spring (14) causes abutment of the contact (13) against the associated carrier or feed part (4), so that contact between the two contact parts (5) is produced again and current can thus flow.

The carrier or feed part (4) is shown in FIG. 3, somewhat reduced, in side view.

In FIG. 4, the end of a weld section (8), which has a wedge-shaped taper (19), is shown enlarged. The thus formed narrow long web (20) comes into connection, in the welding process, with the contact part (5), and is melted by the high current density occurring in the welding process.

In FIG. 5, the end of the weld section, as marked (19), is likewise of wedge-shaped construction.

In FIG. 6, the end of the weld section is of forked construction and includes a central, U-shaped opening 22 that separates the two forks.

The switch component shown in FIG. 9, corresponding in its functioning to that in FIG. 1, has a U-shaped carrier or feed part (4) and a rod-shaped carrier or feed part (4), which can be seen in side view in FIG. 7.

The weld section (8) of a carrier or feed part (4) shown in FIG. 8 consists of two cylindrical bodies of different diameters, the end being formed as a conical point (21).

The construction of the weld section is not limited to the examples described.

We claim:

1. A electrical switch component comprising: an insulating body having an opening extending therethrough, a conductive feed part extending through the opening in the insulating body, a switch unit attached to a first end of the feed part, a contact part connected to a second end of the feed part, wherein the feed part has a body portion and includes a weld section that extends from the body portion and passes through the insulating body, the weld section having a smaller cross section than the body portion, a transition region between the body portion and the weld section and being constructed stepwise to define a support shoulder to limit inward movement of the feed part into the opening in the insulating body, the second end of the feed part defined by an outer end of the weld section end projecting outwardly from the insulating body and connected by a weld to the contact part, wherein the feed part is formed with a U-shape and each of the mutually parallel shanks of the U has a respective body portion adjoining a central, perpendicular shank, and each body portion includes a weld section that passes through the insulating body.

2. A switch component according to claim 1, wherein the feed part is constructed in strip form and the weld section extends through the insulating body.

3. A switch component according to claim 1, wherein the weld section of the feed part has a circular cross section with a conical tip.

4. A switch component according to claim 1, wherein the weld section has a wedge-shaped end taper.

5. A switch component according to claim 1 wherein the second end of the weld section has a central U-shaped aperture to define two mutually spaced-apart weld webs.

6. A switch component according to claim 1, wherein the opening in the insulating body includes a surrounding depression facing the contact part.

* * * * *